US005165760A

United States Patent [19]

Gueret

[11] Patent Number: 5,165,760

[45] Date of Patent: Nov. 24, 1992

[54] PROCESS FOR MAKING A BRUSH FOR APPLYING A COSMETIC PRODUCT

[75] Inventor: Jean-Louis Gueret, Paris, France

[73] Assignee: L'Oreal, Paris, France

[21] Appl. No.: 684,153

[22] Filed: Apr. 12, 1991

Related U.S. Application Data

[63] Continuation of Ser. No. 620,396, Nov. 30, 1990, abandoned, which is a continuation of Ser. No. 417,718, Oct. 5, 1989, abandoned, which is a continuation-in-part of Ser. No. 126,324, Nov. 30, 1987, Pat. No. 4,887,622.

[30] Foreign Application Priority Data

Oct. 12, 1988 [FR] France ..... 88 13410

[51] Int. Cl.[5] ..... A45D 24/00

[52] U.S. Cl. ..... 300/21

[58] Field of Search ..... 300/21; 132/218; 15/159 A

[56] References Cited

U.S. PATENT DOCUMENTS

| | | | |
|---|---|---|---|
| 2,365,396 | 12/1944 | Cunningham | 15/159 A |
| 2,812,530 | 11/1957 | Whitesel | 300/21 |
| 3,103,679 | 9/1963 | Clemens | 15/167.1 |
| 3,233,943 | 2/1966 | Peterson | 15/159 A |
| 3,295,156 | 1/1967 | Brant | 15/159 R |
| 3,325,845 | 6/1967 | Sawkiw | 300/21 |
| 3,330,603 | 7/1967 | Gelardi | 300/21 |
| 3,629,895 | 12/1971 | Colgan | 15/160 |
| 4,403,624 | 9/1983 | Montgomery | 401/129 |
| 4,586,520 | 5/1986 | Brittain | 132/320 |
| 4,828,420 | 5/1989 | Otsuka et al. | 15/159 A |
| 5,020,551 | 6/1991 | Guerret | 132/200 |

FOREIGN PATENT DOCUMENTS

| | | | |
|---|---|---|---|
| 239270 | 9/1987 | European Pat. Off. . | |
| 679174 | 7/1939 | Fed. Rep. of Germany | 15/206 |
| 2511094 | 9/1975 | Fed. Rep. of Germany | 132/218 |
| 2757046 | 7/1979 | Fed. Rep. of Germany | 15/159 A |
| 3505969 | 8/1986 | Fed. Rep. of Germany . | |
| 954436 | 12/1949 | France | 15/159 A |
| 2073621 | 10/1971 | France . | |
| 2505633 | 11/1982 | France . | |
| 2605505 | 4/1988 | France . | |
| 17666 | 9/1895 | United Kingdom | 15/167.1 |
| 14736 | of 1896 | United Kingdom | 15/206 |
| 1321081 | 6/1973 | United Kingdom | 15/DIG. 5 |
| 2170996 | 8/1986 | United Kingdom | 132/218 |
| 2198335 | 6/1988 | United Kingdom | 15/160 |

OTHER PUBLICATIONS

French Search Report of FR 88 13410.

*Primary Examiner*—Mark Rosenbaum
*Assistant Examiner*—John M. Husar
*Attorney, Agent, or Firm*—Cushman, Darby & Cushman

[57] ABSTRACT

A process for making a brush for applying a cosmetic product, for example to the eyelashes or hair, comprises a plurality of bristles transversely implanted in a core (2), in particular formed by a mixture of relatively soft bristles (5) and relatively stiff bristles (4). The relatively soft bristles (4) have a greater length than the relatively stiff bristles, and the outer ends of the relatively stiff bristles are closer to the core of the brush than the outer ends of the relatively soft bristles.

5 Claims, 2 Drawing Sheets

PROCESS FOR MAKING A BRUSH FOR APPLYING A COSMETIC PRODUCT

This is a continuation of application Ser. No. 07/620,396, filed Nov. 30, 1990, now abandoned, which itself was a continuation of Ser. No. 07/417,718, filed Oct. 5, 1989, now abandoned, which itself is a continuation-in-part of Application Ser. No. 07/126,324, filed Nov. 30, 1987, now U.S. Pat. No. 4,887,622 of Dec. 19, 1989.

BACKGROUND OF THE INVENTION

The invention concerns a brush for the application of a cosmetic product. This brush is particularly adapted to the application of mascara to the eyelashes but can also be used for hair treatment, such as dyeing.

Generally, the brushes are made by implanting a plurality of bristles transversely on a core. This core can be in the shape of a plate. Another form of the brush core is formed by two branches of a helically twisted metallic wire, the bristles being fixed in the spirals formed by these twisted branches. This type of brush is very widely used for the application of mascara.

When a brush is provided with relatively soft bristles, only a small amount of the product remains on the bristles following the wiping which takes place when the brush is removed from the reservoir container of the product. The resulting make-up will be weak. Moreover, when the soft bristles are pressed down against the core, the eyelashes cannot enter between these bristles which lie on top of one another during the making up.

If the brush is provided with stiffer bristles, whether or not mixed with softer bristles, the stiffer bristles remain more heavily charged with the product after wiping, in particular if they are provided with capillary grooves. The interspacing between the bristles can be increased, thereby allowing the eyelashes to be well separated, but the quantity of the product deposited on the lashes is variable, in particular over the length of lash, and the make-up obtained is not always satisfactory, since the effect of the softer bristles is cancelled by the stiffer bristles.

SUMMARY OF THE INVENTION

The present invention provides a brush comprising a core having implanted therein plurality of bristles formed by a mixture of relatively soft bristles and relatively stiff bristles which are shorter than said relatively soft bristles, wherein the outer ends of the relatively stiff bristles are nearer the core of the brush than the outer ends of the relatively soft bristles.

It has been found that brushes in which the relatively soft bristles are longer than the relatively stiff bristles make it possible in a satisfactory way, and at one and the same time, to take up a constant quantity of product for depositing on the eyelashes, and to comb and smooth the eyelashes. They have, moreover, the advantage of permitting a very natural make-up of the lashes without lumps.

The difference in stiffness of the bristles can be obtained by modifying their diameter, this latter method being preferred. For example, in the case of bristles formed of nylon or polyester fibres, the relatively soft bristles have a diameter of less than 10 hundredths of a millimetre, whilst the relatively stiff bristles have a diameter greater than 10 hundredths of a millimetre and generally less than 30 hundredths of a millimeter.

The brush bristles whether stiff or soft, can be of animal or synthetic origins, for example, of nylon or polyester. The bristles of a natural origin can be used in mixtures with synthetic fibres.

The cross-section of the bristles, in particular of the larger diameter stiff bristles, can have variable shapes. The cross-section can be of a solid circular shape, hollow circular shaped, or multilobal, in particular trilobal or horseshoe, shaped. Bristles which are hollow or comprise capillary grooves are advantageous because they serve as reservoirs for the mascara or for the hair product. This type of bristle is described, for example, the U.S. Pat. Nos. 4,887,662 and 4,993,440.

The stiff bristles and the soft bristles can be distributed in a regular manner.

In one particular embodiment of the invention, the outer ends of the relatively stiff bristles are situated on a first surface having a contour different from the second surface whereon the ends of the relatively soft bristles are situated, and the first surface is situated inside the second surface. Advantageously, the contours of the first surface and of the second surface, in a cross-section perpendicular to the core of the brush, are constituted by circles, preferably concentric circles.

The contour of the second surface can be polygonal, preferably triangular. This latter embodiment has the advantage of making it possible to modify the make-up according to the position of the brush around its axis.

In a second embodiment of the invention, the relatively stiff bristles which generally have the largest diameter, have been cut open in such a way as to form a plurality of small hooks. These bristles provided at their ends with small hooks have the advantage of clinging to the lashes or hair in a better way and so as to facilitate their smoothing.

These bristles are generally cut open by grinding.

The grinding of the bristles is preferably effected on the brush after the relatively stiff bristles and the relatively soft bristles have been fixed on the core of the brush. The grinding then has a substantial effect, essentially on the stiff bristles, and makes it possible at one and the same time to shorten the stiff bristles and to open up their ends so as to form small hooks. On the other hand, during the grinding, the soft bristles bend and escape from the grinder and they are practically neither shortened nor cut open. The grinding operation thus results in a brush in accordance with the invention comprising shorter stiff bristles and longer soft bristles.

The description given below on a non-restrictive basis and with reference to the accompanying drawings will be conducive to a better understanding of the invention. In the drawings:

DETAILED DESCRIPTION OF THE INVENTION

Figure 1:
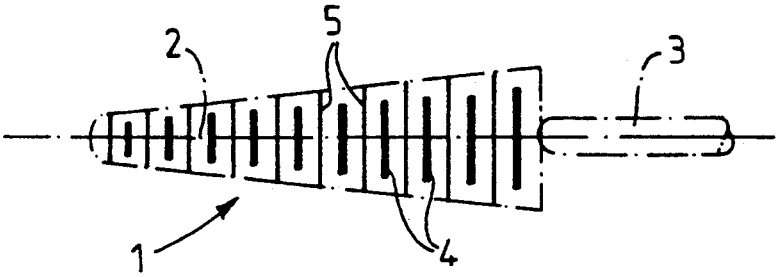
FIG. 1 is a schematic longitudinal section of a mascara brush in accordance with the invention.

FIG. 1 schematically represents a brush 1 of a conventional type for applying mascara to the eyelashes. It is constituted by a substantially linear core 2 formed by two branches of a twisted metallic wire carrying a plurality of bristles 4 and 5 mounted transversely in relation to the core 3. The core is fixed on a handle 3.

In FIG. 1, the brush has a conical shape, the end with the larger cross-section being situated adjacent the handle. The bristles are disposed in a spiral form and in each turn there are stiff short bristles 4 and long soft bristles 5, these bristles being disposed in a regular manner. The ends of the soft long bristles 5 and those of the stiff short bristles 4 each form a respective conical surface, the conical surface formed by the ends of the stiff short bristles 4 being inside the conical surface formed by the soft long bristles 5.

Figure 4A:
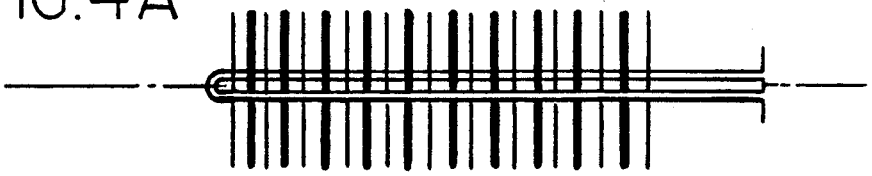
Figure 4B:
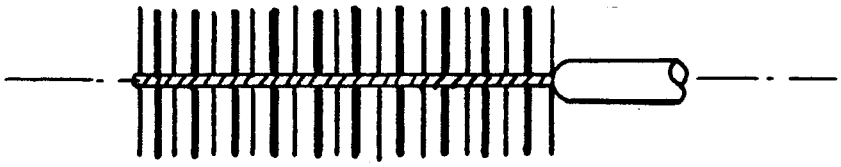
Figure 4C:
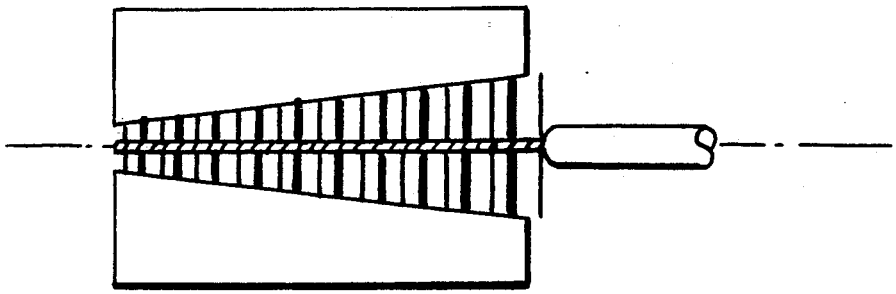
Figure 4D:
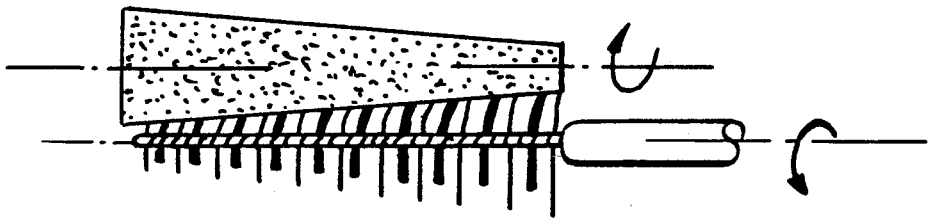
Figure 4E:
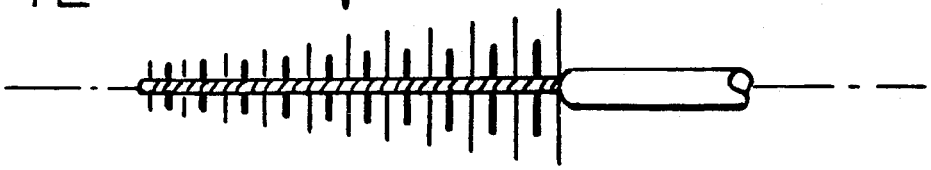

The brush 1 is manufactured as follows. The stiff bristles 4 and the soft bristles 5 are introduced as shown in FIG. 4A between the two branches of a metallic wire forming a U, and the two branches are then twisted together as shown in FIG. 4B. The bristles 4 and 5 are then fixed between the twisted branches of the core 2. After the bristles have been mounted, the brush generally has an approximately cylindrical shape. The brush 1 is brought to its cylindrical shape by means of shearing machine, in the conventional way as shown in FIG. 4C. The brush 1, having a conical shape is subsequently ground. The grinding is for example effected by causing the brush 1 to turn around the axis of its core 2, while the grinder is caused to turn in the opposite direction as shown in FIG. 4D. The grinder leaves the soft bristles 5 intact. On the other hand, the stiff bristles 4 are shortened and their ends are cut open into hook shapes. The surface formed by the ends of the short stiff bristles is variable according to the grinding effected.

Figure 2:
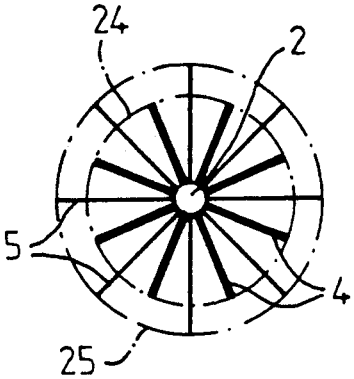
FIG. 2 is a schematic cross-section of the brush of FIG. 1, on an enlarged scale.

FIG. 2 shows the cross-section perpendicular to the core of the brush where the contour 25 of the surface formed by the ends of the long soft bristles 5 and the contour 24 of the surface formed by the ends of the short stiff bristles 4 are concentric circles centered on the brush core 2.

Figure 3:
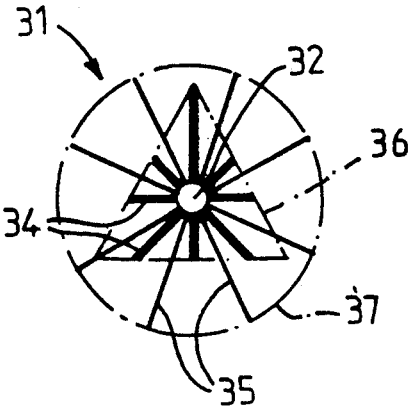
FIG. 3 is a schematic cross-section of a variant of the embodiment.

FIG. 3 shows a transverse cross section of a brush 31 in which the long soft bristles 35 form a surface whose contour is a circle 37 and the short stiff bristles 34 form a surface whose contour is an equilateral triangle 36, the centre of symmetry of the triangle 36 lying at the core 32 of the brush 31.

According to the invention, the soft bristles supported at their base by the stiff bristles do not lie down, and instead allow a natural make-up to be obtained.

The eyelashes can be separated and smoothed and be made up over their whole length without producing any lumps in the product.

The soft bristles can be thinned out at the surface, beyond the stiff bristles. The stiff bristles form a reservoir for the product.

I claim:

1. A method for making a brush for the application of cosmetic product, the method comprising the steps of:

introducing a plurality of rigid and soft bristles between two branches of a metallic wire bent to form a U-shape with the bristles being disposed in a regular manner;

twisting the two branches of the wire to an extent to fix the rigid and soft bristles between the twisted branches;

and then subjecting the bristles of the brush to grinding with a grinder with the grinder rotating in one direction and the brush rotating in an opposite direction so that the rigid bristles are cut off and their ends are cut in the form of a hook shape while the soft bristles are deflected during grinding and remain substantially uncut and unground.

2. The process as claimed in claim 1, wherein before the grinding step, the bristles of the brush are shaped by cutting.

3. The process as claimed in claim 2, including the step of cutting the bristles so that the brush has a conical shape before grinding.

4. The process as claimed in claim 1, wherein the grinding step is carried out so that the ends of the soft bristles lie on a circular surface of a selected diameter and the ends of the rigid bristles lie on a concentric circle having a smaller diameter.

5. The process as claimed in claim 1, wherein the grind in is effected so that the cut-off rigid bristles form a surface having a contour which is an equilateral triangle the center of symmetry of which is the axis of the brush.

* * * * *